United States Patent [19]

Julien Saint Amand

[11] 4,443,331

[45] Apr. 17, 1984

[54] PROCESS AND DEVICE FOR SEPARATING PARTICLES IN A FLUID ESPECIALLY FOR THE CLEANING OF THE SUSPENSIONS HANDLED IN THE PAPER INDUSTRY

[75] Inventor: François Julien Saint Amand, Grenoble, France

[73] Assignee: Centre Technique de l'Industries des Papiers Carton et Celluloses, Grenoble, France

[21] Appl. No.: 245,938

[22] Filed: Mar. 20, 1981

[30] Foreign Application Priority Data

Mar. 21, 1980 [FR] France ..... 80 07244

[51] Int. Cl.[3] ..... B04B 1/08

[52] U.S. Cl. ..... 209/211

[58] Field of Search ..... 209/211, 144; 210/512.1; 55/409; 233/27, 28

[56] References Cited

U.S. PATENT DOCUMENTS

| | | | |
|---|---|---|---|
| 1,712,184 | 5/1929 | Wendel . | |
| 2,796,808 | 6/1957 | Scott | 209/211 |
| 2,864,499 | 12/1958 | Teuteberg | 209/211 |
| 2,967,618 | 1/1961 | Vane | 209/211 |
| 3,010,579 | 11/1961 | Duesling | 209/211 |
| 3,428,175 | 2/1969 | Hukki | 209/211 |
| 3,454,163 | 7/1969 | Read | 209/211 |
| 3,616,992 | 11/1971 | Deacon | 233/1 A |
| 3,642,129 | 2/1972 | McDaniel et al. | 209/211 |
| 3,648,840 | 3/1972 | Bobo | 209/211 |
| 3,859,206 | 1/1975 | Baggaley | 209/211 |
| 3,942,728 | 3/1976 | Christ et al. | 209/211 |
| 4,178,234 | 12/1979 | Bobo | 209/211 |

FOREIGN PATENT DOCUMENTS

| | | |
|---|---|---|
| 465775 | 6/1973 | Australia . |
| 889192 | 1/1944 | France . |
| 2080117 | 10/1971 | France . |
| 2091170 | 1/1972 | France . |
| 2238534 | 2/1975 | France . |
| 2293983 | 7/1976 | France . |
| 253544 | 3/1948 | Switzerland . |
| 1476670 | 6/1977 | United Kingdom . |

*Primary Examiner*—Tim R. Miles

*Attorney, Agent, or Firm*—Arnold, White & Durkee

[57] ABSTRACT

A process and device for selectively separating particles from a suspension is disclosed. The process involves: introducing the suspension into a rotating separation chamber in which the flow is regulated so that the angular velocity of the suspension is maintained slightly higher than the angular velocity of the wall of the chamber. The bulk of the flow of the suspension treated is removed from the separation chamber from a peripheral area. The following fractions are removed separately, simultaneously, and if necessary continuously. The heavy fraction is removed from a zone near of the sidewall; the light fraction is removed from a zone nearer of the longitudinal axis of the chamber, than the heavy fraction outlet and if desired, an intermediate fraction may be removed from at least one separate intermediate zone between the light fraction outlet and the heavy fraction outlet. The apparatus comprises a separation chamber having a longitudinal axis, sidewalls and two ends; inlets through the first end for introducing suspension and auxiliary fluid; rotating means for deviating suspension and auxiliary fluid towards the sidewalls outlets for the heavy and the intermediate fractions in the second end of the separation zone; rotating means to collect the effluents from areas nearer the sidewalls to their respective outlets; and a light fraction outlet is provided in the first end of the separation chamber and is colinearly aligned with the longitudinal axis. Rotating means are provided to rotate the separation chamber around its longitudinal axis. Numerous alternative embodiments are described.

13 Claims, 10 Drawing Figures

PROCESS AND DEVICE FOR SEPARATING PARTICLES IN A FLUID ESPECIALLY FOR THE CLEANING OF THE SUSPENSIONS HANDLED IN THE PAPER INDUSTRY

BACKGROUND OF THE INVENTION

This invention relates to a process for separating particles suspended in a fluid; it also relates to an improved device for the separation of such particles, whether solid, liquid, or gaseous.

This invention has potential applications in many fields. It will be particularly suitable to the paper industry, without being limited thereto. More specifically, it will be useful for the treatment of solutions containing suspended particles, such as: fibrous suspensions from waste papers; paper pulps to be cleaned; effluent water from a paper machine in which separate collection of the fibers or fillers, waste water, and the like is desirable.

In the description, the invention is more specifically described in the context of applications relating to the paper industry. It shall be understood that this specific embodiment has only been chosen as an illustrative example. In fact, the invention may have other applications in situations which require classification or fractionation performed by centrifugal means such as the recovery of nonmiscible liquids of different specific gravities, within mixtures, and the like. Likewise, although the fluid is usually liquid, such as water, it may also be gaseous.

Solutions with suspended particles, which are handled in the paper industry, contain the following main elements in relative proportions which vary a great deal:

a fluid carrier (usually an aqueous solution), natural, artificial, or synthetic fibers, more or less individualized, solid particles which vary a great deal in size and specific gravity (mineral contents, miscellaneous impurities: hot melt, plastics, inks, adhesives, tars, metallic particles, sand, and the like) which shall be referred to as "contaminants", and also, liquid or gaseous particles (air).

The cleaning process for a suspension involves separation of one or several fractions of undesirable particles from the said suspension, and in the particular case of paper making, recouperation of a fibrous suspension free from contaminants which are detrimental in future recycling.

Among the procedures presently known for such treatment of suspensions, the most commonly used are based on the principle of separation according to the differences in the particles' specific gravity or size. In these procedures the suspension is introduced into a revolution chamber where it flows in a vertical motion called a "vortex". The particles in the suspension are therefore subjected to the simultaneous action of two forces:

the centrifugal force, resulting from the centrifugal acceleration acting on the mass of each particle and tending to draw such particle from the center outward;

and the centripetal force, due to the action of the radial pressure gradient on the volume of the particle tending to draw such particle towards the center of the vortex.

If the specific gravity of the particle is equal to that of the fluid carrier, these two forces balance each other and there is no average radial motion of the particle with respect to the fluid.

However, if the suspended particle has a specific gravity less than that of the fluid carrier, the effect of the radial pressure gradient is higher than the effect of the centrifugal force. In that instance, the particle moves toward the longitudinal axis of the vortex. On the other hand, if the particle has a specific gravity greater than that of the fluid carrier, the effect of the radial gradient is lower than the effect of the centrifugal force and the particle moves to the periphery of the revolution chamber.

To make the description easier to follow, the terms "light particles" or "light components" shall represent particles of a density lower than that of the fluid carrier, while terms "heavy particles" or "heavy components" represent those of a density higher than that of the fluid carrier.

The components whose density is either lower or higher than that of the fluid carrier, but whose migration velocity is low essentially due to their very small size, both constitute a fraction hereafter designed "intermediate fraction".

Devices called "hydrocyclones" or "centricleaners", which are made of a stationary conical chamber, have been suggested. In these devices, the suspension to be cleaned is tangentially introduced at the head of the conical chamber; the heaviest particles are removed at the opposite end; and the solution thus cleaned then is collected at the head of the chamber close to the longitudinal axis.

These hydrocyclone devices have usually proved efficient for separating the heavy particles (sand, metallic particles, and the like) but have given poor results for separating light particles, especially those of a density close to that of the fluid carrier.

In fact, in a cleaning apparatus of the hydrocyclone type with a stationary wall, the only adjustable operational parameter for a given device is the tangential velocity of inflow of the suspension. In order to eliminate the heavy particles at the periphery, this velocity must be maintained at a rather high rate, which causes a rapid flow through the central portion of the apparatus, and therefore does not permit a sufficient amount of time for the desired dissociation of the light particles. Accordingly, nearly all of the light particles are found in the "cleaned suspension".

Furthermore, the use of high velocities imparts throughout the suspension a very high turbulence level which counteracts the effect of separation between the various particles.

In order to facilitate the elimination of the light particles in this type of apparatus, it has been suggested that a small diameter plunging tube be placed in the center of the vortex in order to remove the low density contaminants. The proportion of light contaninants thus separated, however, remains rather low, due to the reduced size of the central zone of the vortex.

In the cases of suspended solutions where the contaminants to be removed are mainly light ones, it has also been suggested that the suspension be tangentially injected into a cylindrical chamber having stationary walls and also tangentially removed while the contaminants are extracted axially. In this type of apparatus, the solution flows at a much lower velocity resulting in a low radial pressure gradient throughout the solution which does not permit the elimination of the lightest particles.

A cleaning device is described in French Pat. Nos. 2,091,170, and 2,293,983, which tried to use a large driving force and avoid the problem of turbulence. This device, aiming at meeting theoretical forced vortex conditions as much as possible, is comprised of two concentric cylindrical walls rotating in synchronism. In operation, the suspension is introduced into the annular space thus formed between the concentric walls and flows through it in such a manner that the suspension and the walls rotate together as one unit. However, the efficiency of this device is limited by the effect of the concentration of the suspension to be cleaned due to the absence of agitation which results in a rapid clogging-up of the device. Furthermore, in the case of solutions with suspended fibers, the morphology of the fiber components in the suspension creates an additional impediment affecting the operating efficiency of this device. In the absence of agitation, the fiber components tend to rapidly aggregate into a coherent network which "traps" the contaminants and prevents them from moving within the fluid.

U.S. Pat. No. 1,712,184 describes a forced vortex system with rotating divergent walls, wherein the solution is introduced through the bottom and flows into the area of reduced pressure created by the wall's rotation. Due to the divergence of the wall, the velocity of the suspension is always lower than that of the wall. This significantly limits the efficiency of the separation, and therefore does not permit controlling the time the solution remains inside the device independently of the velocity of rotation. In practice, this device lacks versatility to the extent that it only permits variation of the velocity of rotation.

In the Australian Pat. No. 465,775, a classic hydrocyclone is described wherein its wall is made to rotate in order to superimpose a forced vortex upon the free vortex created in the hydrocyclone. Here the suspension is tangentially introduced with an angular velocity higher than that of the wall. However, here the majority of the heavy particles are collected approximately along the longitudinal axis of the hydrocyclone, and the light particles are also collected along the same axis. A loss of the suspension's kinetic energy of rotation results therefrom since most of the suspension to be recovered is recovered axially and all the fluid kinetic energy is dispersed within the vortex. Furthermore, the rotating outlet device acting like a pump, when operating results in an additional amount of energy consumption. On the other hand, as mentioned before, the described embodiment does not make it possible to have a large centrifuging zone for the particles in the center of the vortex, since all the cleaned suspended solution is collected near the longitudinal axis.

If the device of Australian Pat. No. 465,775 were modified to be cylindrical instead of conical (this hypothesis was not described however), the heavy components could be collected at the periphery while the bulk of the suspended solution could be recovered at the center. This modification presents some disadvantages similar to those mentioned in the above embodiment. Again, it would be impossible to recover the kinetic energy of rotation and the benefit of the favorable effects of a large zone of centrifugation in the central portion of the vortex, for the elimination of the heavy components.

SUMMARY OF THE INVENTION

The present invention overcomes the disadvantages of the various cleaning machines discussed above. It relates to a process and device used for treating suspensions based on the free vortex action with a rotating wall, wherein a minimum agitation is maintained at the periphery of the whole vortex which permits a continuing and efficient separation and extraction of the various fractions of the suspensions treated. This type of apparatus permits separation of components from fibrous suspensions such as paper plugs.

This process for selectively separating particles from a suspension includes:

rotating a separation chamber about a longitudinal axis such that when a fluid is inside the separation chamber it forms a free vortex in the said chamber;

introducing a suspension into the separation chamber in a slightly oblique direction with respect to the longitudinal axis of the chamber and causing the suspension to flow with an angular velocity slightly larger than the angular velocity of the wall;

controlling the flow of the suspension in the chamber, in order to maintain this excess of angular velocity and, separately removing:

the heavy components from a zone near the sidewalls of the separation chamber;

the light components from a zone near longitudinal axis of the chamber;

an intermediate fraction from at least one intermediate zone between the removal zones for the heavy components and for the light components;

a major part of the treated suspension being collected from a zone near the periphery of the vortex.

As the major part of the suspension which has been treated is collected at a zone near the periphery of the vortex, most of the energy initially imparted to the suspension when introduced may be recovered at the discharge end. On the other hand, the removal of light components from a zone within the vortex axis allows a large central centrifuging zone; therefore, there is an important centrifugation area in the center.

In order to maintain the minimum degree of agitation necessary to individualize the motion of the components, it is essential that the free vortex within the rotating wall be formed predominantly of several concentric layers having convergent conical shapes. This may be achieved by introducing the suspension at a predetermined velocity and angle with respect to the longitudinal axis of the separation chamber. The angular velocities of fluid within a layer should be greater than the angular velocity of the fluid within the adjacent outer layer in order to maintain a certain shearing of the layers. This conical shape may result from the conical shape of the rotating chamber; or else it may be independent of the geometry of this wall (for instance a cylindrical chamber); or finally, it may be obtained by adjusting the inflow and the outflow velocities of the suspension. Thus, the inflow velocities can be adjusted to achieve for each corresponding layer the desired angular velocity of the suspension and in particular, the desired excess of this velocity with respect to over that of the wall. The outflow rates can be adjusted to achieve convergence of the flow with respect to the longitudinal axis, and therefore achieve a flow path in a conical shape.

In practice, the value of the oblique angle with respect to the longitudinal axis of the separation chamber at which the suspension is introduced into the separation chamber is fixed by the ratio of the modulus of the axial velocity, a function of the flow rate to the velocity with respect to the wall of the separation chamber, the latter velocity being determined according to the desired degree of agitation.

The radial "migration velocity" of the particles with respect to the fluid varies essentially according to the shape, dimensions, and specific gravity of the particles, as well as to the characteristics of the flow itself. The migration velocity will be lowest when the difference of the specific gravity between the particles and the fluid carrier is lowest, when the particles are smallest, and when the shape of the particles is most detrimental for migrating.

In an improved embodiment of the present invention, an auxiliary fluid is introduced along the walls of the chamber. The auxiliary fluid permits dilution of the suspension in the peripheral area and an increase in the mobility of the particles in that area.

The presence of this annular zone of auxiliary fluid reduces the distance which the light particles of the suspension must travel when entering into the apparatus in order to reach a zone near the axis of the vortex where they will be removed.

Finally, the presence of this annular zone of fluid achieves a "wash out" of the smallest components from the suspension which have a very low migrating velocity and are not being driven by the heaviest components when the latter cross this annular zone of fluid.

It will also be preferred, in practice, to take advantage of the natural axial return motion in the center of the free vortex by promoting this motion using an axial exit for the light components. The centrifugal separation effect is therefore very amplified in the vortex zone closest to the axis.

Thus, it is possible to extract from the separation chamber at the end of the vortex nearest the suspension inlet, even if the flow rates are low, almost all the light fraction of the suspension, free of heavy components. If the suspension contains gaseous particles, those are gathered within the axial zone where they form a gaseous nucleus.

An appropriate device in which this separation process for suspensions can be performed comprises:

a separation chamber having a longitudinal axis, side walls, and first and second ends;

an inlet at the first end for introducing suspensions into said separation chamber colinearly aligned with the longitudinal axis;

rotating means in fluid communication with suspension inlet for deviating flow of incoming suspension towards the side walls of the chamber and directing it tangentially at the desired angle;

a heavy fraction outlet from the chamber positioned at the second end colinearly aligned with the longitudinal axis an intermediate fraction outlet from the chamber, also positioned at the second end of the separation chamber, and colinearly aligned with the longitudinal axis but nearer to the axis than the heavy fraction outlet;

rotating means in fluid communication with said heavy fraction outlet and said intermediate fraction outlet for collecting flows from concentric areas near the side wall, the heavy fraction being collected at the outer peripheral area and the intermediate fraction at the inner peripheral area, and deviating them towards their respective outlet;

a light fraction outlet in the first end of the separation chamber, the light fraction outlet being colinearly aligned with the longitudinal axis; and rotating means for rotating the separation chamber about its longitudinal axis.

If an additional fractionation of the intermediate fraction is desired, multiple outlets for intermediate fractions may be arranged at the second end of the separation chamber concentrically to each other between the heavy fraction outlet and the longitudinal axis.

Alternatively, an additional outlet for a light fraction may be colinearly aligned with the longitudinal axis on the same end of the separation chamber as the other intermediate and heavy fractions outlets.

In another embodiment, an additional inlet is provided at the inlet end of the separation chamber closer to the periphery than the suspension inlet to allow introduction of an auxiliary fluid.

An outlet for heaviest components may also be moved along the wall of the separation chamber away from the ends. Such outlets may be preceded by short divergent section.

In a system adapted for removal of heavy components the separation chamber can be constructed with a frustoconical shape having its larger end at the inlet end and equipped with outlets diverging off its periphery for removing heavy components.

A further alternative embodiment has additional inlets for auxiliary fluid, either continuously along the sidewall of the separation chamber, or at various points along the sidewalls.

Additional control of the suspension into the separation chamber can be effected by equipping both inlet and outlet rotation deviations means with means to modify the angular velocity of the suspension with respect to the angular velocity of the wall of the separation chamber. Such a device could be comprised of channels inclined with respect to the longitudinal axis of the chamber, which promote an increase the vortical motion of the suspension flowing through them.

The rate at which light components are removed from the separation chamber can be increased causing a concomitant increase in centrifuging the heavy components in the central zone of the vortex by connecting a pressure reducing device to the outlets positioned near the longitudinal axis.

Further cleaning of suspensions issuing from the separation chamber can be effected by directly connecting a pump with at least one of the outlet rotating deviating means for supplying a recycle line or a down stream line.

Briefly, to summarize, all the equipment at the inlet end of the separation chamber operates like a pump, while the systems at the opposite end operate like a turbine.

It is understood that the rotating deviating means may be extended beyond the confines of the separation chamber by means such as a pump which operates in conjunction with the rotating deviating means for the purpose of feeding effluents to downstream lines.

BRIEF DESCRIPTION OF THE DRAWINGS

The various embodiments of the invention, their operation, and the advantages deriving therefrom shall be more clearly illustrated with the following examples given as an indication with the figures annexed thereto, however, the scope of the invention shall not be limited to these examples.

DETAILED DESCRIPTION

Figure 1:
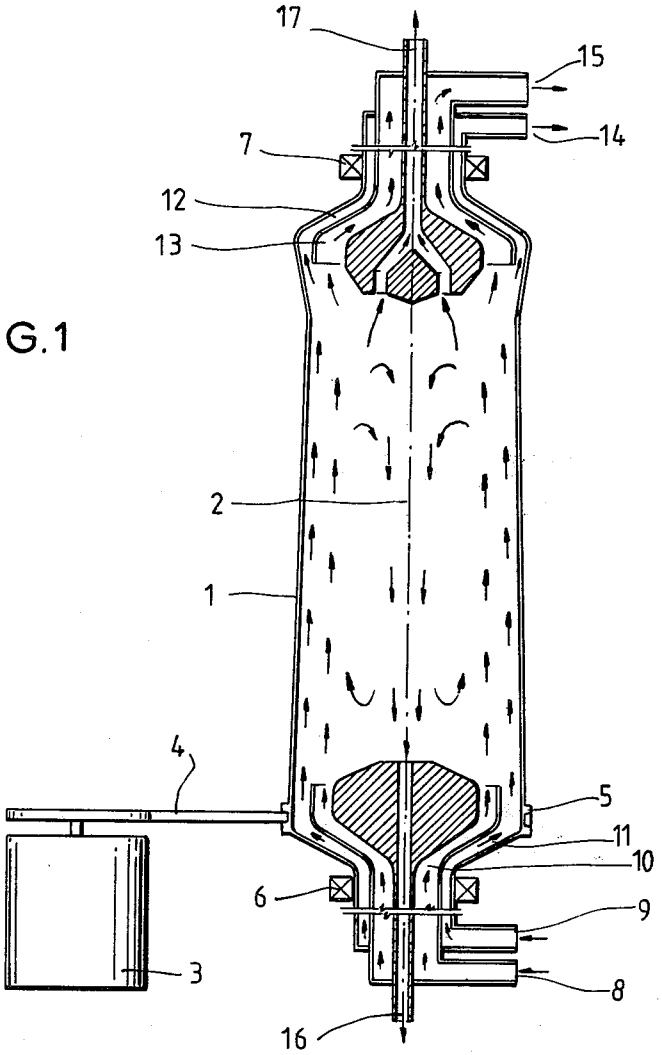
FIG. 1 is a schematic view of a profile section of a cleaning machine in accordance with the invention, with a flow diagram.

With reference now to FIG. 1, the cleaner of the present invention is comprised of a separation chamber 1 which in the preferred embodiment has a very slightly conical shape. It can be made of any suitable material such as stainless steel or plastic. The separation chamber 1 is driven in rotation about its longitudinal axis 2 by means of an engine 3 which drives a belt 4 running on a groove 5 installed for that purpose on the outer periphery of the separation chamber 1. Bearings 6 and 7 are connected to classical seals at the ends of the separation chamber 1 (not shown), allowing the chamber 1 to rotate about its axis 2. Suspension inlet 8 allows introduction of the suspension to be cleaned through a swivel connection at the head of the separation chamber 1 and an annular passage 10 which operates as a rotating deviating device. Auxiliary fluid inlet 9 allows introduction of an auxiliary fluid through a swivel connection, also at the head of the separation chamber 1, and an annular passage 11 concentric to passage 10 but farther from the longitudinal axis 2 than passage 10 serves as a rotating deviating device.

Opposite the inlets 8 and 9 and their respective rotating deviating devices 10 and 11 are outlets comprised of two stationary passages 14 and 15. Heavy fraction outlet 14 connects in fluid communication by means of water-tight connections to the annular passage 12 closest to the sidewalls to allow discharge of the heavy fraction. Intermediate fraction outlet 15 connects in fluid communication to annular passage 13 to allow the discharge of the intermediate fraction. These annular passages 12 and 13 are concentric to each other and constitute the deviating means which collect most of the flow of the suspension from near the sidewalls of the separation chamber, and then deviate the said flow towards the longitudinal axis 2. This deviation allows recovery of the major part of the fluid kinetic energy of rotation associated with suspension rotating in the separation chamber 1.

A light component outlet 16 placed at same end of the separation chamber as inlets 8 and 9 and colinearly aligned with the longitudinal axis 2 of the separation chamber 1 allows recovery of the lightest components at the base of the vortex created by the swirling suspension. Collection of light components at the end of the separation chamber 1 opposite the heavy fraction outlet 14 and the intermediate fraction outlet 15 increases the centrifugation work in the central area of the vortex. A second outlet for light fraction 17 can be located at the opposite end of the separation chamber from the outlet 16 and colinearly aligned with the longitudinal axis 2 to allow discharge of the rest of the light particles as well as the very fine ones.

Although the apparatus is usually built with the axis of rotation 2 horizontal it may also be vertical. Likewise, the bearings 6 and 7 may be positioned elsewhere, for instance on the chamber itself, or they may be replaced with equivalent systems, such as a set of tires driving the separation chamber by friction against its outer wall.

The fact that the separation chamber 1 rotates about its axis 2 allows control of the driving forces of the separation process independently of the intensity of agitation of the suspension. Without intending to limit the scope of the invention, it is believed that this ability to independently control the two forces results because the driving forces of separation depend upon the velocity of rotation of the suspension while the degree of turbulence depends upon the relative velocity of the suspension with respect to the wall, which is maintained so that the velocity of the suspension slightly exceeds that of the wall. Accordingly, the operating conditions, i.e. the velocity of the separation chamber and the angular velocity of the suspension may be adjusted to accommodate different flow rates of suspensions to be treated without affecting efficiency.

Figure 10:
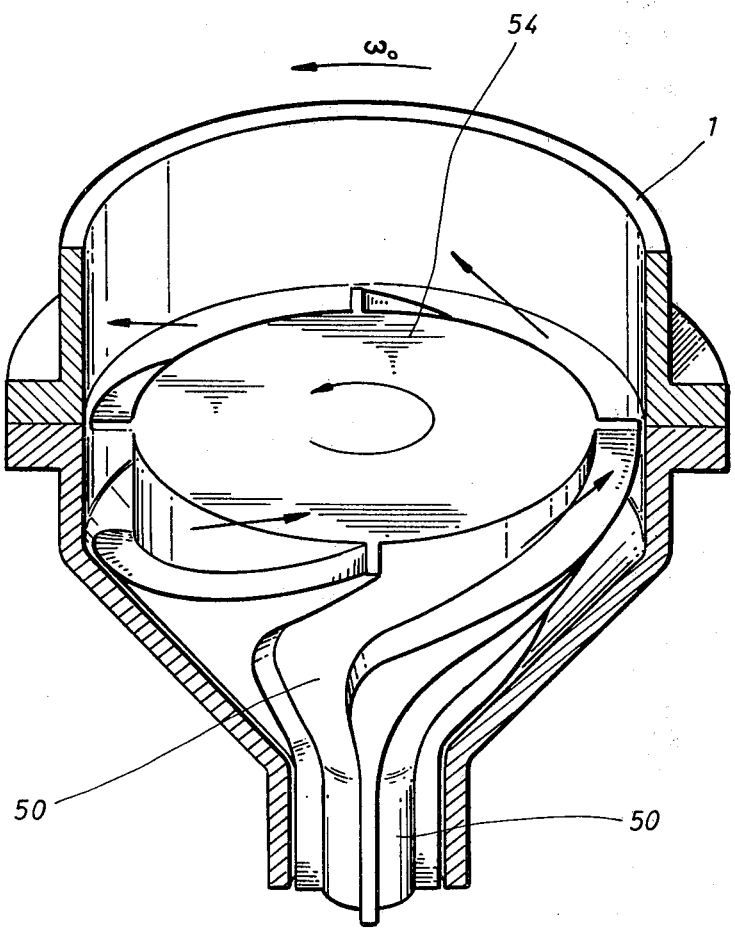
FIG. 10 shows a device for achieving an angular velocity of suspension greater than the angular velocity of the wall.

The rotating deviating devices 10 and 11 direct the flow of the suspension entering near the axis 2 towards the sidewalls of the separation chamber 1. They are shown in more detail in FIG. 10 and are comprised of a plurality of channels 50 inclined with respect to the axis 2, in order to drive more efficiently the incoming suspension and auxiliary fluid into a vertical motion. They permit control of the suspension's angular velocity Wo with the help of only the respective variations of the incoming flow rate of suspension and the auxiliary fluid.

The structure of the rotating deviating devices 12 and 13 is similar to that of the rotating deviating devices 10 and 11, but these passages 12 and 13 return the suspension from the periphery of the separation chamber 1 back towards the axis 2. This structural symmetry between the supply area and the discharge area is favorable to the recovery upon discharge of most of the kinetic energy of rotation imparted to the fluid in the supply area.

To give an illustrative example of the operation of the apparatus of the present invention, we shall describe the trajectory of the particles or components to be separated, within various embodiments in the context, unless otherwise specified, of cleaning paper pulp.

Figure 2:
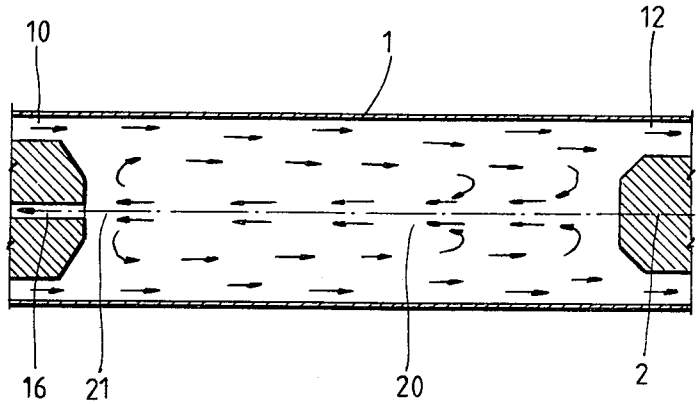
FIG. 2 is a diagram of the path of the fluid carrier within a cylindrical rotating chamber.

EXAMPLE 1 (See FIG. 2)

In this example, the separation chamber 1 is cylindrical.

Here, the paper pulp to be cleaned is a suspension containing a mixture of fibers and light contaminants. The suspension is introduced into the apparatus through inlet 10 which is placed in the peripheral zone of the vortex which results upon rotation of the separation chamber and of the suspension.

When flowing through the inclined channels 50 provided inside the supply inlet 10 the suspension is driven into a vertical motion with an angular velocity which has been provided slightly higher than that of the wall, due to the inclination of these channels with respect to the axis of rotation 2.

Accordingly, the flow conditions of the suspended solution are of the "free vortex" type, such as that utilized in cyclone devices. However, the minimum degree of agitation which is maintained at the periphery of the separation chamber and which results because the angular velocity of the suspension only slightly exceeds that of the wall, permits reduction of friction to the level strictly necessary for the free mobility of particles in the suspension.

In such conditions, the action of the centrifugal and centripetal forces may develop without any disturbance in the entire vortex, and therefore, with the maximum efficiency. Thus, the majority of the particles lighter than the fluid are rapidly drawn towards the axial zone 20 where they progressively concentrate by slowly returning to the supply area 21. At that point, they are removed free of fibers through a light fraction outlet 16.

During the rotation of the separation chamber 1 loaded with the suspension, any gaseous particles in the suspension aggregate in the axial zone of the vortex where they form a gaseous nucleus 20, generally at reduced pressure. In large apparatuses, the formation of a rather large gaseous nucleus in the center has the advantage of lowering the general level of the pressures in the apparatus.

The particles heavier than the fluid are drawn towards the periphery of the separation chamber 1 with a greater efficiency since their path is not disturbed by excessive turbulence.

Such a device with a cylindrical or slightly convergent wall is especially suitable for extraction of light components from fibrous suspensions such as paper pulps.

Figure 3:
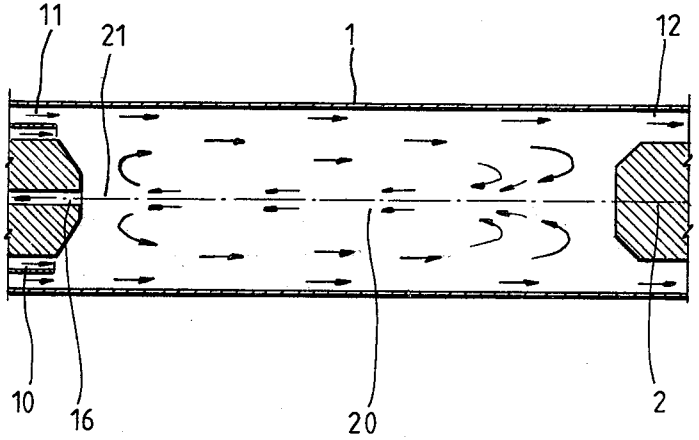
FIG. 3 shows a variation of the system of FIG. 2 with means for injecting auxiliary fluid.

EXAMPLE 2 (See FIG. 3)

In a variation of the invention, the dissociation of the fiber network can be increased by diluting the suspension to be cleaned in the area next to the wall of the separation chamber with an auxiliary fluid introduced through an outer inlet 11 adapted for regulation of flow.

Figure 4:
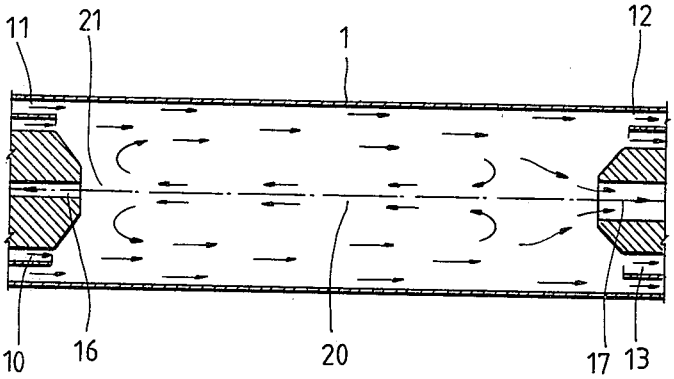
FIG. 4 shows another variation of the systems shown in FIGS. 2 and 3, especially suitable for fractionation of the suspension being discharged.

EXAMPLE 3 (See FIG. 4)

Here the discharge end of the separation chamber is equipped with three concentric annular passages 12, 13, and 17.

A fiber suspension containing light components is introduced through inlet 10 while auxiliary fluid, for example, water is introduced through inlet 11.

The light components are extracted through outlet 16. In the outermost annular passage 12 a fraction of cleaned suspension is collected, which is then richer in long suspended fibers, while "fines" (fragments of fibers and small sized particles) are collected in the innermost annular passage 17 and the intermediate fraction is collected in the intermediate annular passage 13.

This embodiment of the process is especially suitable to the fractionation of the fiber suspensions in the paper industry.

Figure 5:
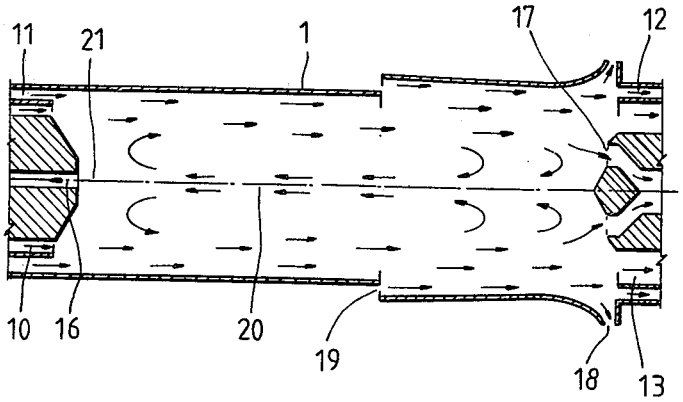
FIG. 5 shows a variation of the systems shown FIGS. 2, 3, and 4, especially suitable for the separation of heavy particles.

EXAMPLE 4 (See FIG. 5)

In a particularly interesting embodiment of the invention, the cleaning of a fibrous solution containing both light and heavy components may be performed as a continuous operation by cutting openings in the side wall of the separation chamber 1, which are connected to tangential passages 18 which may extend outwards to prevent their clogging-up. The heaviest particles which are concentrated near the wall are extracted through these passages 18.

Advantageously inlet devices 19 are installed in the wall of the separation chamber 1 before the outlet passages 18 for injecting auxiliary fluid which washes out heavy components before they are extracted.

Thus, heavy components practically free of fibers are extracted through the discharge passages 18.

The light contaminants are removed though outlet 16; a completely cleaned suspension is removed through outlet 13; a fraction of the suspension still containing some heavy contaminants is removed through outlet 12; and a fraction of the suspension still containing some light contaminants is removed through outlet 17. The fractions collected through outlets 12 and 17 may subsequently be recycled to complete their purification.

Of course, if the fractionation of the solution with suspended fibers is not required, then only the discharge passages 12, 16 and 18 would be necessary.

Figure 6:
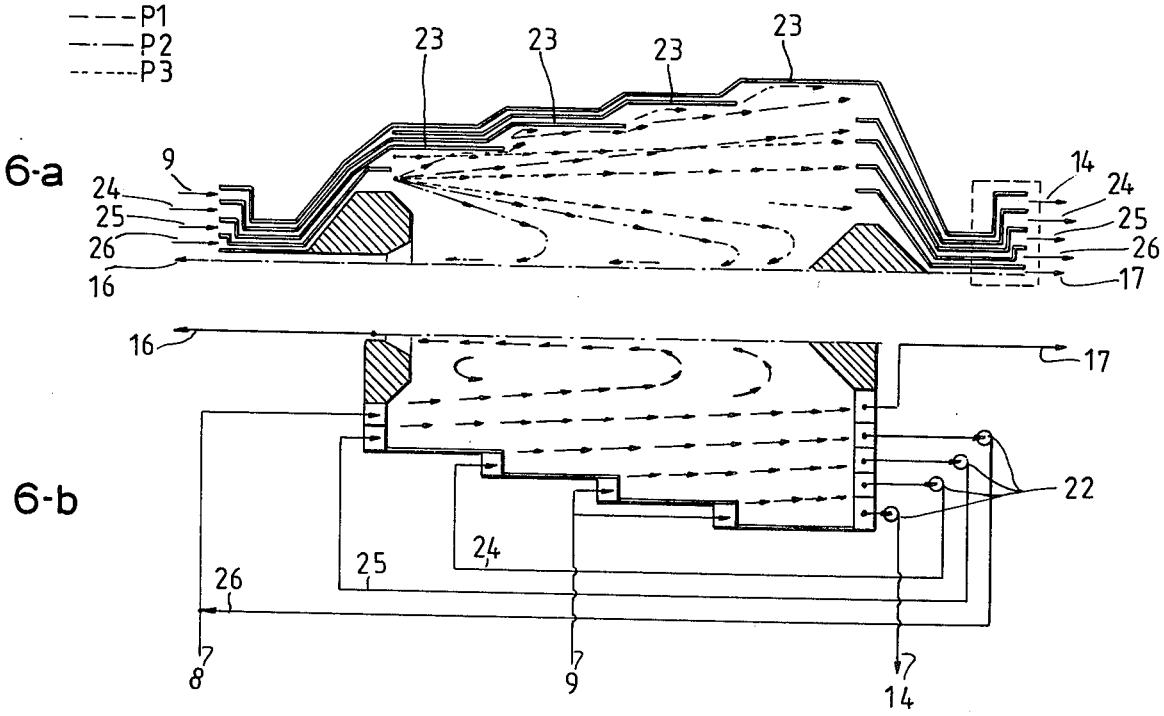
FIG. 6 (including views 6-*a* and 6-*b*) shows another embodiment wherein the separation chamber has cylindrical sections in increasing diameters, and is adapted for injection of auxiliary fluid from various points on the wall.

EXAMPLE 5 (See FIG. 6)

FIGS. 6*a* and 6*b* illustrate another embodiment of the invention wherein the divergent general conical shape of the unit is obtained by connecting a series of cylindrical sections 23 of increasing diameters. A supply of water or other auxiliary fluid is introduced through passage 9.

FIG. 6*a* is a schematic diagram showing half a section of the apparatus and the average trajectory of the particles in motion (P1—heavy particles; P2—light particles; P3—the finest particles).

FIG. 6*b* is a schematic diagram of recycling lines and of the flow of the fluid carrier.

Such an apparatus is especially suitable for cleaning a suspension containing very fine segregated contaminants, with migrating velocities that are practically negligible compared to those of the other components of the suspension.

In this case, the suspension to be cleaned is introduced, preferably concentrated, through passage 8, and auxiliary fluid is introduced through passage 9.

As before, the light and very fine particles are respectively removed through passages 16 and 17. The cleaned suspension is removed through passage 14. Finally, in passages 24, 25 and 26, fractions are removed which contain very fine contaminants in increasing concentrations. The particles removed through passages 24, 25 and 26 are recycled to the head of the apparatus to be reintroduced at different levels along the walls of the sections 23.

The rotating deviating systems associated with the outlet passages 14, 24, 25 and 26 are each connected to a pump 22, which permits feeding the downstream and recycling lines at the desired pressure.

The fluid screen formed by the auxiliary fluid along the wall operates as a selective filter which permits the heavy particles (fibers for instance) to migrate towards the sidewalls, while it screens the very fine particles.

Such a device is especially suitable for removing ink from waste paper pulps and its use has proved satisfactory for such treatments.

Other variations of the invention may also be constructed, wherein the sections 23 are designed with a slight convergence or divergence according to the intended purpose of the operation. Divergent sections are especially suitable for elimination of the heaviest particles, while convergent sections tend to increase the velocities of rotation of the fluid.

Figure 7:
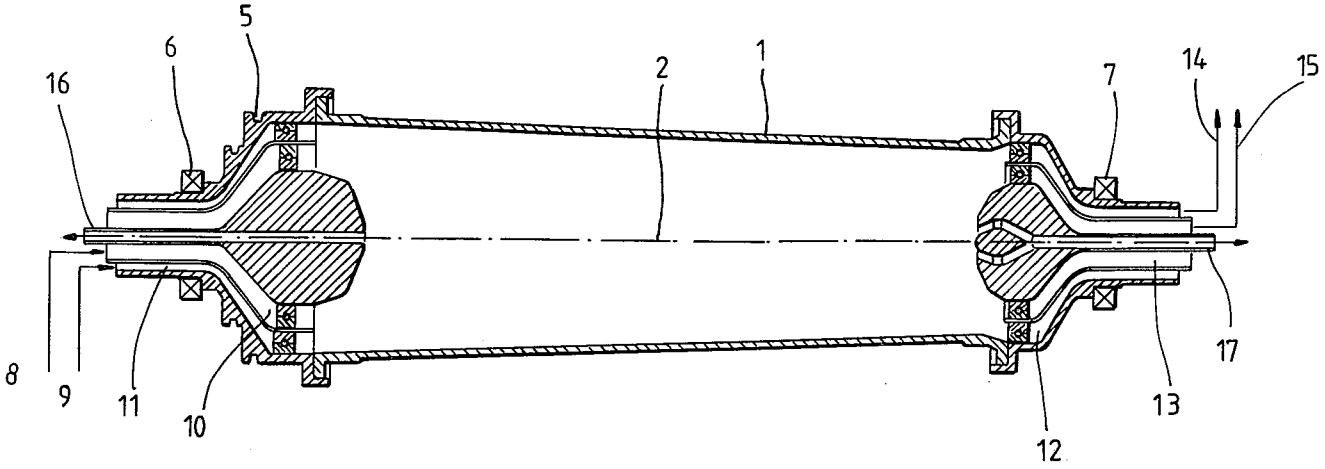
FIG. 7 shows the rotation part of an experimental apparatus for the implementation of the invention.

EXAMPLE 6 (See FIG. 7)

FIG. 7 shows the separation chamber 1 of an experimental apparatus adapted to rotate at a speed of 1,650 RPM, wherein the separation chamber 1 is about 75 cm long, and has a 24.5 cm inner diameter. This chamber shows a slightly conical wall (3.5% conicity).

The machining of such an apparatus is a little more difficult to achieve than with one with a cylindrical wall, but such an apparatus has proved satisfactory especially in preventing the clogging-up and promoting the elimination of the light components.

A suspension of paper pulps to be cleaned, which contains fibers and light contaminants, is introduced through passage 8-10 and water (recycling water from the plant may be used) is introduced through passage 9-11.

The cleaned suspension is extracted through outlet 14. An incompletely cleaned and more diluted fraction is extracted through outlet 15. This fraction may be recycled by reintroduction through passages 8 or 9. Light contaminants free of fibers are extracted through passage 16. Eventually a fraction with the finest elements in suspension may be extracted through passage 17.

The elimination rate achieved with a 4" diameter TRICLEAN hydrocyclone, of a commercial classical type equipped with a stationary wall, manufactured by the Bird Machine Co., Inc. was compared to that achieved with the experimental separation device described above and shown in FIG. 7. The classical hydrocyclone eliminated in one run approximately 30% of 0.5 mm particles having a 0.98 specific gravity, when paper pulp with a 7.5 g/l concentration was fed with a 150 l/min. flow rate.

With the device of the invention as shown in FIG. 7, and with the same paper pulp containing the same components, the elimination rate in one single run will be 97% for a 300 l/min. flow rate. The loss of fibers will be ten times lower (losses of fibers therefore reduced from about 1.5% to about 0.15%).

In order to obtain a comparable cleaning rate with the above-mentioned TRICLEAN hydrocyclone, the suspension would have to be run through the machine at least ten consecutive times. Such repetition would result in much too high an energy consumption.

To establish another type of comparison, assuming that a 50 cm diameter rotary hydrocyclone is manufactured to rotate according to the specifications of the Australian Pat. No. 465,775, at 1,500 RPM, a feeding pressure exceeding 10 Kg would be required to form a free vortex within the chamber and to achieve a significant flow. If not, the flow treated would be insufficient, and the results of the separation would be poorer, due to the excessive turbulence resulting from the tangential velocities exceeding by several tens of meters/second the velocity of the wall in the bottom of the cone. Furthermore, the separation area in the center would be too small to obtain a satisfactory separation between the various components.

Figure 8:
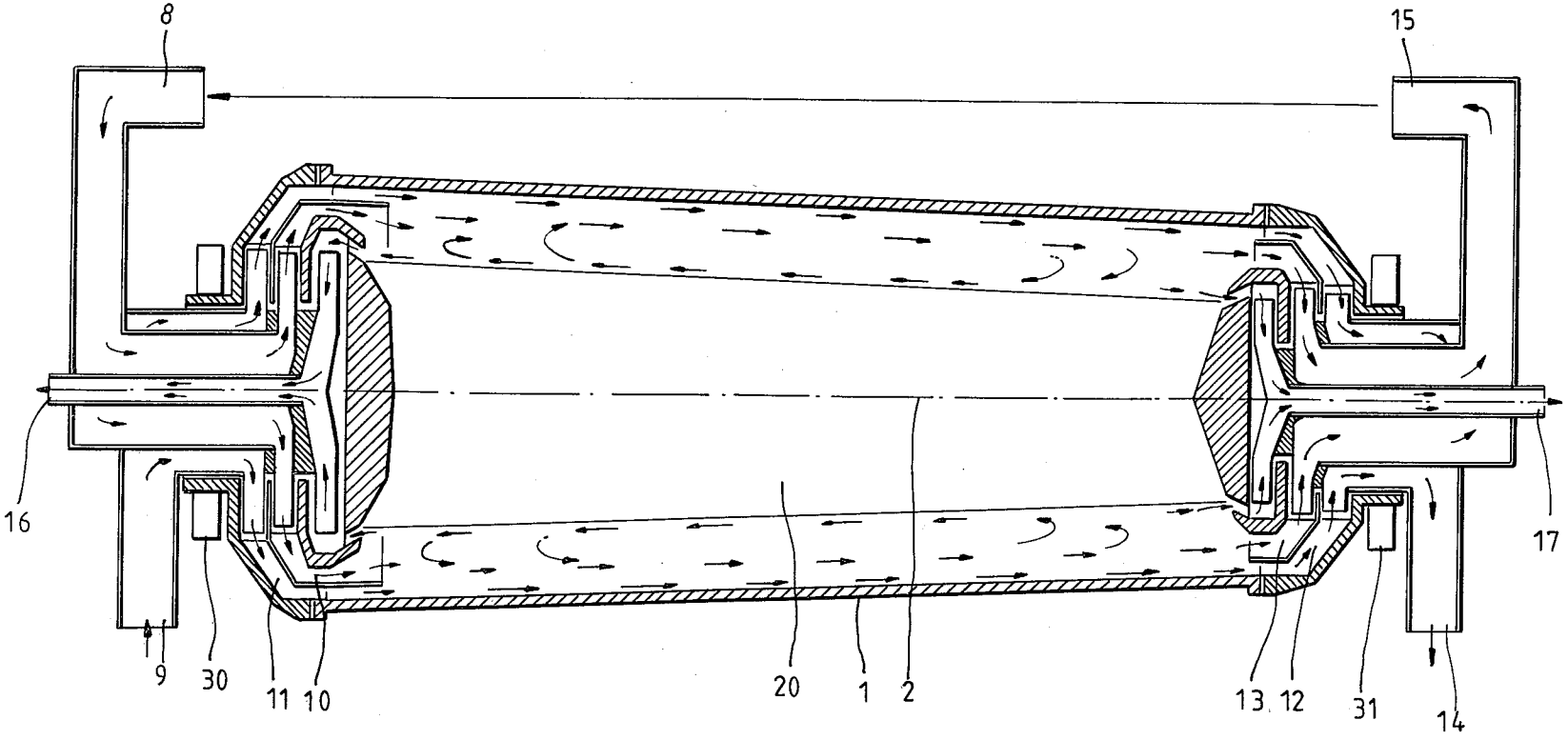

EXAMPLE 7 (See FIG. 8)

FIG. 8 shows a cleaner with a conical chamber without any seal ring, designed for treatment of heavy flows (for instance flows of 10,000 cubic meters per hour) of suspensions containing light particles, whether solid or liquid, such as in water-petroleum mixtures. In this FIG. 8, the portions drawn with crossed lines represent the stationary parts, while the portions drawn with parallel oblique lines represent the rotating parts. However, here the bearings 6 and 7 (as shown in preceeding figures) are replaced with set of tires 30 and 31. Outlet passages for light components 16 and 17 are aligned on the longitudinal axis 2, but they originate not exactly from the center of the vortex, but from the periphery of large air nucleus 20, regulated at reduced pressure, by well-known means not shown, such as a vacuum pump, in order to obtain the centrifugal effect necessary without increasing the general level of the pressures.

In operation, the suspension (water-petroleum) to be cleaned is introduced through inlet passage 9. The cleaned fraction (water) is withdrawn through outlet 14, an incompletely cleaned fraction is extracted through outlet passage 15 and recycled through inlet passage 8, while the light fraction (petroleum) is extracted through outlet passage 16.

Part of the light fraction is extracted through outlet passage 17 and contains a small enough amount of water so that this mixture can be processed later on by well-known means.

Thus, it has been estimated that, for a 10-meter long chamber, with an approximate volume of 35 cubic meters, about 10,000 cubic meters per hour could be satisfactorily treated, and at a velocity of the separation chamber 1 wall of about 90 km/h (300 RPM), an average centrifugal acceleration of 160 g, a maximum inner pressure of 8 kilogram per square centimeter, and with the velocity of the fluid exceeding that of the wall by about 2 m/sec.

Figure 9:
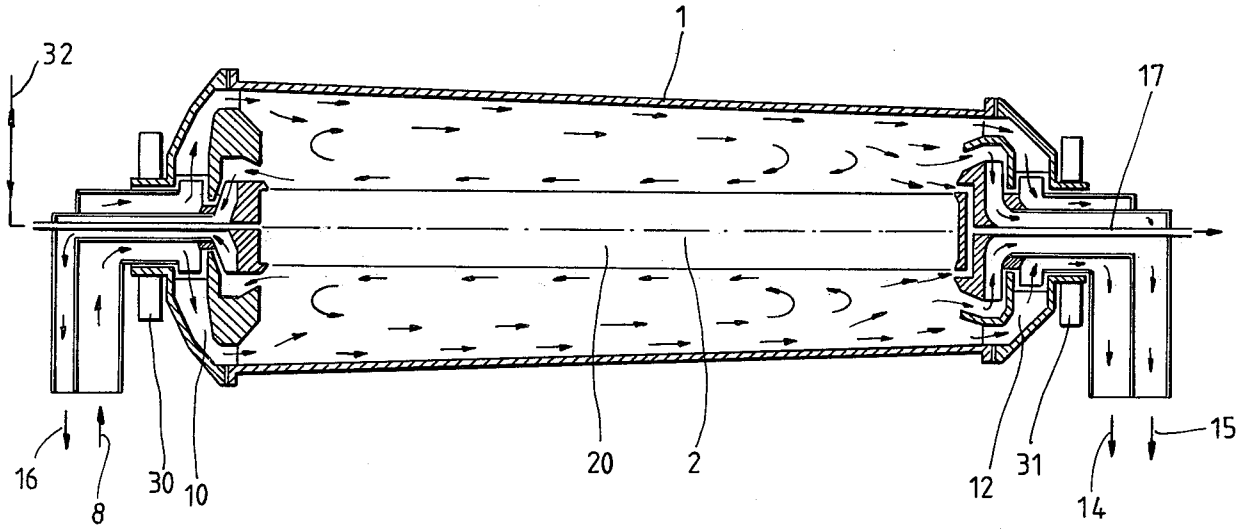
FIGS. 8 and 9 show two improved devices for the purification of large quantities of suspension.

EXAMPLE 8 (See FIG. 9)

FIG. 9 shows a cleaner, also constructed with a conical separation chamber 1 and without any seal ring, which is designed for heavy flows. Such an apparatus is especially suitable for the cleaning of dilute suspensions such as for instance a slightly concentrated paper pulp containing light contaminants.

In this embodiment an air nucleus 20 is maintained at reduced pressure in the same way it was regulated before through the line 32.

It has been estimated that with such an apparatus having a 5-meter long separation chamber and a 5.5 cubic meter inner volume, about 1,000 cubic meter per hour could be cleaned, when the wall rotates with a velocity of about 70 km/h (700 RPM) an average centrifugal acceleration of 300 g, a maximum inner pressure of 15 kilograms per square centimeter, and with the velocity of the fluid exceeding that of the separation chamber 1 wall by about 3 m/sec.

EXAMPLE 9 (See FIG. 5)

Another operating procedure is especially suitable for the cleaning of concentrated suspensions. This process comprises introducing the suspension to be cleaned on the top side of the vortex, the vortex at this moment is mainly formed by the auxiliary fluid, (and in the case of recycling by the recycled suspension), introduced through inlet passages 10 and 11.

The initially concentrated suspension is thus introduced through a passage 17 into the center area of the vortex, where the axial return motion originates, amplified by a sufficient extraction flow from the outlet passage 16.

This arrangement, which in practice does not modify the pattern of the stream since the flow introduced through inlet passage 17 is low compared to the total flow rate circulating through the apparatus, effects an increase in the radial distance to be travelled by the heavy components, and therefore improves the selectivity for these heavy components.

This operating procedure may be used in every type of apparatus designed with an escape for the heavy contaminants. The only necessary change in its construction is to reverse the direction of the oblique directing channels in passage 17.

The apparatus of the present invention offers many advantages compared to the devices known today. Here are a few:

It is possible to maintain velocity of the suspension along the entire periphery at a level slightly higher than the velocity of the wall whatever the apparatus length may be. This differential permits increased selectivity in separating the various fractions of the suspension treated, and reduction of pressure drops, and therefore the energy consumption; it also permits utilization of large-sized apparatuses, specifically designed for certain purposes, with an excellent efficiency.

It is possible to recover most of the kinetic energy of rotation imparted to the suspension which permits use of large-sized apparatuses with a low energy consumption.

It is possible in a single apparatus to extract heavy particles and light particles simultaneously and continuously. Similarly, various fractions of the purified suspension can be separated. This versitility makes this apparatus suitable for multi-purpose operations.

It is possible to introduce at least an auxiliary fluid, which permits, if necessary, improved cleaning by "washing out" and recycling certain fractions of the suspension.

Consequently, this apparatus may be satisfactorily utilized for the treatment of various suspensions which include:

the cleaning of paper pulps, from waste paper for instance;

the ink removal in the processes used for removing the ink from waste paper stocks;

the fractionation of various paper pulps;

the treatment of waste or polluted waters;

the efficient separation of particles having a specific gravity rather close to that of the fluid in which they are in suspension.

The foregoing description has been directed to the particular preferred embodiments in accordance with the requirements of the Patent Statutes for the purposes of illustration and explanation. It will be apparent however, to those skilled in the art that many modifications and changes in the procedures and devices set forth will be possible without departing from the scope and spirit of the invention. It is the applicant's intention that the following claims be interpreted to embrace all such modifications and variations.

What is claimed is:

1. A process for selectively separating particles from a suspension which comprises:

rotating a separation chamber about a longitudinal axis such that when a fluid is inside the separation chamber it forms a free vortex in said chamber;

introducing a suspension into the separation chamber in a slightly oblique direction with respect to the longitudinal axis of the chamber and causing the suspension to flow with an angular velocity slightly larger than the angular velocity of the wall;

controlling the flow of the suspension in the chamber, in order to maintain this excess of angular velocity so that the free vortex is comprised of multiple concentric layers having convergent conical shapes;

collecting the major part of the treated suspension from a zone near the periphery of the vortex and deviating the suspension towards the longitudinal axis; and separately removing:

the heavy components from a zone near the sidewalls of the separation chamber;

the light components from a zone near the longitudinal axis of the chamber; and an intermediate fraction from at least one intermediate zone between the removal zones for the heavy components and for the light components.

2. The process of claim 1 which comprises introducing an auxiliary fluid along the wall of the said separation chamber.

3. An apparatus for selectively separating particles from a suspension which comprises:

a separation chamber having a longitudinal axis, sidewalls, and first and second ends;

an inlet at the first end for introducing suspensions into said separation chamber colinearly aligned with the longitudinal axis;

inlet rotating means in fluid communication with the suspension inlet for deviating flow of incoming suspension from the longitudinal axis towards the sidewalls of the chamber and directing it tangentially at the desired angle which inlet rotating means are adapted to regulate the angular velocity of fluid flowing through the inlet;

a heavy fraction outlet from the chamber positioned at the second end colinearly aligned with the longitudinal axis;

an intermediate fraction outlet from the chamber also positioned at the second end of the separation chamber and colinearly aligned with the longitudinal axis but nearest to the axis than the heavy fraction outlet;

outlet rotating means in fluid communication with said heavy fraction outlet and said intermediate fraction outlet for collecting flows from concentric areas near the sidewall, the heavy fraction being collected at the outer peripheral area and the intermediate fraction at the inner peripheral area, and deviating them towards their respective outlets near the longitudinal axis which outlet rotating means are adapted to regulate the angular velocity of fluid flowing through the outlets;

a light fraction outlet in the first end of the separation chamber, the light fraction outlet being colinearly aligned with the longitudinal axis; and rotating means for rotating the separation chamber about its longitudinal axis.

4. Apparatus according to claim 3 comprising an auxiliary fluid inlet in fluid communication with the rotating deviating means and arranged concentric to said suspension inlet and close to said sidewalls of the separation chamber.

5. Apparatus according to claim 4 comprising auxiliary fluid inlets along the sidewall of the separation chamber.

6. Apparatus according to claim 3 comprising a second light component outlet colinearly aligned with said longitudinal axis in said second end of said separation chamber.

7. Apparatus according to claim 3 comprising at least one additional outlet including openings in the sidewall of the said separation chamber for discharge of heavy components.

8. Apparatus according to claim 6, comprising a plurality of intermediate fraction outlets at the second end of the said separation chamber concentrically of each other and located between the heavy fraction outlet and the said additional light fraction outlet.

9. Apparatus according to claims 3 or 7 comprising for each said additional heavy component outlet a divergent portion of the sidewall upstream with respect to said additional outlet adapted for discharging said heavy components.

10. Apparatus according to claim 3 further comprising rotating pumping means extending to at least one discharge rotating deviating means adapted to feed fluid to a downstream line.

11. Apparatus according to claim 3 further comprising means adapted to reduce the pressure of an air nucleus formed in the center of said separation chamber during rotation of said separation chamber about its longitudinal axis.

12. Apparatus according to claim 3 or claim 6 further comprising pressure reducing means adapted to increase the flow rate of the discharge of the light fraction.

13. An apparatus for selectively separating particles from a suspension which comprises:

a separation chamber having a longitudinal axis, sidewalls, first and second ends, a suspension inlet adapted for introducing suspension into a first end of said chamber about said longitudinal axis;

a first rotating inlet means in fluid communication with said suspension inlet for deviating flow of incoming suspension from the longitudinal axis towards the sidewalls of the chamber and directing it tangentially at the desired angle;

an auxiliary fluid inlet for introducing said auxiliary fluid into the first end of the chamber about said longitudinal axis;

a second rotating inlet means in fluid communication with said auxiliary fluid inlet for similarly deviating flow of said fluid from the longitudinal axis towards the sidewall and positioned outside concentrically of the first inlet rotating means;

a first light fraction outlet in the first end of the separation chamber, said light fraction outlet being colineraly aligned with the longitudinal axis of the separation chamber;

a second light fraction outlet in said second end of said separation chamber being colineraly aligned with said longitudinal axis;

a heavy fraction outlet in said second end of said chamber positioned concentrically to the second light fraction outlet;

an intermediate fraction outlet in said second end of said separation chamber positioned between said heavy fraction outlet and said second light fraction outlet;

rotating outlet means similar to the rotating inlet means and symetrically positioned for collecting from concentric areas near the sidewall the flow of the heavy fraction at the outer area, the flow of the second light fraction at the intermediate position, then deviating said flows toward their respective outlets near the longitudinal axis;

channels provided in the inlet rotating means and outlet rotating means for regulating the angular velocity of fluid flowing through them;

rotating means for rotating said separation chamber about its longitudinal axis.

* * * * *

UNITED STATES PATENT AND TRADEMARK OFFICE

CERTIFICATE OF CORRECTION

PATENT NO. : 4,443,331

DATED : April 17, 1984

INVENTOR(S) : Francois Julien Saint Amand

It is certified that error appears in the above—identified patent and that said Letters Patent is hereby corrected as shown below:

Column 4, line 12, delete "plugs" and insert --pulps--.

Column 6, line 34, delete "deviations" and insert --deviating--.

Column 6, line 39, delete "an" and insert --and--.

Signed and Sealed this

Sixth Day of August 1985

[SEAL]

*Attest:*

DONALD J. QUIGG

*Attesting Officer* *Acting Commissioner of Patents and Trademarks*